US007641566B2

(12) United States Patent
O'Connor et al.

(10) Patent No.: US 7,641,566 B2
(45) Date of Patent: Jan. 5, 2010

(54) GOLF EXERCISE DEVICE

(76) Inventors: Maureen O'Connor, 1261 Summit Pl., Cardiff, CA (US) 92007; Alfred O'Connor, 1261 Summit Pl., Cardiff, CA (US) 92007

( * ) Notice: Subject to any disclaimer, the term of this patent is extended or adjusted under 35 U.S.C. 154(b) by 132 days.

(21) Appl. No.: 11/972,727

(22) Filed: Jan. 11, 2008

(65) Prior Publication Data

US 2009/0181788 A1 Jul. 16, 2009

(51) Int. Cl.
*A63B 69/36* (2006.01)
*A63B 22/00* (2006.01)

(52) U.S. Cl. ..... 473/219; 473/266; 473/274; 473/276; 473/286; 473/197; 482/51

(58) Field of Classification Search ..... 473/219, 473/257, 266, 270, 274, 275, 276, 277, 286, 473/197; 482/51
See application file for complete search history.

(56) References Cited

U.S. PATENT DOCUMENTS 985,114 A * 2/1911 Covell ..... 43/12
2,619,755 A * 12/1952 Henson ..... 43/12
4,798,219 A * 1/1989 Forde ..... 135/16
4,979,754 A * 12/1990 Eisenhart ..... 473/474
5,248,287 A * 9/1993 Nicoletti ..... 482/106
5,255,835 A * 10/1993 Burks ..... 224/666
5,775,751 A * 7/1998 Nelson ..... 294/19.2
5,788,608 A * 8/1998 Wilkinson ..... 482/51
5,934,530 A * 8/1999 Antczak et al. ..... 224/197
6,003,262 A * 12/1999 Beaty ..... 43/12
6,202,911 B1 * 3/2001 Freer ..... 224/684
6,234,675 B1 * 5/2001 Saad et al. ..... 383/38
6,276,007 B1 * 8/2001 Brown ..... 5/81.1 R
2007/0272588 A1 * 11/2007 Longacre ..... 206/581

* cited by examiner

*Primary Examiner*—Sebastiano Passaniti
(74) *Attorney, Agent, or Firm*—Eric Hanscom; Todd Langford

(57) ABSTRACT

A golf exercise device is disclosed that can be used for stretching the shoulder and back muscles. The device expands to a length that allows the user to place the device behind the user's head and grasp each end with the user's hands. The device collapses to a size small enough to easily fit into a golf bag. The center portion of the device is padded for comfort while the user is stretching. Clips can also be included to secure the device to the external portion of the golf bag. The device can hold golf balls in one end, and a net for retrieving golf balls from water hazards in the other. Zippered pockets can be attached to the device to hold personal items such as mobile phones, PDA's, sunglasses, car keys, or the like. Net-type bags with drawstring closures can also be included with the device.

13 Claims, 4 Drawing Sheets

GOLF EXERCISE DEVICE

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the invention: This invention relates to the general field of exercise devices, and more specifically toward a golf exercise device that can be used for stretching the shoulder and back muscles. The device expands to a length that allows the user to place the device behind the user's head and grasp each end with the user's hands. The device collapses to a size small enough to easily fit into a golf bag. The center portion of the device is padded for comfort while the user is stretching. Clips can also be included to secure the device to the external portion of the golf bag. The device can hold golf balls in one end, and a net for retrieving golf balls from water hazards in the other. Zippered pockets can be attached to the device to hold personal items such as mobile phones, PDA's, sunglasses, car keys, or the like. Net-type bags with drawstring closures can also be included with the device.

Stretching before physical activity is often recommended. In golf, instructors recommend that the golfer stretch the shoulder and back muscles before teeing off. Golfers with back injuries or otherwise have weak backs are strongly encouraged to stretch so that further injury will not occur to the back while they are playing golf.

Golfers will often use their golf clubs to aid them in stretching their back and shoulder muscles. The golfer takes his or her golf club, such as an iron, places it behind his or her head across the shoulders, and grasps each end with his or her hands. The golfer enters into various positions with the golf club behind his or her head to stretch out different muscles in the shoulders and back. However, Using a golf club to aid in stretching has several drawbacks. Stretching with a golf club can be uncomfortable. While one end of the golf club may be padded, the other end is the head of the club, which is not comfortable to grasp. Further, there is no padding along the central portion of the shaft of the club to rest against he golfer's neck or back. Another drawback of using a golf club to aid in stretching is that the shaft of the golf club can become curved and deformed, especially after repeated uses as an aid in stretching. When the golfer then uses the golf club to hit a golf ball, the results can be unexpected due to the irregular shape of the shaft.

There are devices other than golf clubs that can be used for stretching. For example, a metal, wood, or plastic bar that is not used for golfing could be placed behind the golfer's head, across the shoulders, and grasped at each end to aid in stretching. However, this bar would not collapse down into a smaller, more convenient size when not in use. Placing the bar with the other clubs could damage the clubs or, at a minimum, unnecessarily clutter the golfer's bag. Also, the bar could not hold additional golf balls, contain a net for retrieving balls, or any other attachments that reduce the clutter of the golf bag and increase the convenience of the device.

Thus there has existed a long-felt need for a device that can be used for stretching before or while playing golf. It should collapse to a smaller size so that it can fit into a golf bag or clip onto the side without unnecessarily cluttering the golfer's bag or disrupting the enjoyment of the game of golf. The device should have the ability to carry additional golf balls and retrieve golf balls from water hazards. An attachment should be included with the device to hold the golfer's other personal accessories, such as keys, mobile phone, and sunglasses.

The current invention provides just such a solution by having a golf exercise device that can be used for stretching the shoulder and back muscles. The device expands to a length that allows the user to place the device behind the user's head and grasp each end with the user's hands. The device collapses to a size small enough to easily fit into a golf bag. The center portion of the device is padded for comfort while the user is stretching. Clips can also be included to secure the device to the external portion of the golf bag. The device can hold golf balls in one end, and a net for retrieving golf balls from water hazards in the other. Zippered pockets can be attached to the device to hold personal items such as mobile phones, PDA's, sunglasses, car keys, or the like. Net-type bags with drawstring closures can also be included with the device.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

This invention is a device that aids a golfer in stretching his shoulder and back muscles, often performed before playing golf. The device is roughly cylindrical in shape and has a telescoping feature, allowing the device to be expanded or collapsed. When expanded, the device should have a length that is roughly the arm span of the golfer, in other words, a length that is about the distance from the golfer's left hand to the golfer's right hand when his or her arms are fully extended perpendicular to the length of the body. When collapsed, the device should be small enough to fit into a pocket of the golf bag, or be easily attached to the outside of the golf bag without interfering with the golfer's normal use of the golf bag.

The size of the shaft should be sufficiently large enough so that golf balls can be stored in one end. In this end, there should be a compartment that stores golf balls. This compartment can be accessed through an opening at the end of the device where the compartment is located. A net can also be included with the device, located at the opposite end of the device from the end that stores the golf balls. This net is used for retrieving golf balls from locations such as water hazards. When the net is not in use, it can collapse and telescope down into the device. Padding is also included with the device to make it more comfortable while being used for stretching. Each end of the device has padding around the external surface to provide additional comfort while gripping the device. Padding is also located in the middle portion of the device to cushion that bar as it rests against the back of the golfer's neck while stretching.

The golf exercise device can also have an attachment that adds functionality to the device. It is attached to the middle portion of the device such that when the golfer is using the device to stretch, the attachment is facing away from the golfer. Various means can be used to secure the attachment to the device, such as snaps, hook and loop fasteners, straps, or the like. The attachment can also be used separate from the device. For example, the attachment could be secured to a golf bag while the device is being used for stretching. The attachment can have various pockets, bags, and compartments, which can be closed by means of zippers, drawstrings, or fasteners. Personal items such as mobile phones, PDAs, sunglasses, and keys can be stored in these compartments. A means for fastening tees to the attachment is also contemplated by the inventor. Clips can be added to attach a scorecard and pencil to the outside of the attachment. Collapsible mesh bags or water resistant bags can also be included to hold other larger items, where these bags, when not in use, can be folded and stored inside of the attachment. The attachment can also have a business card compartments for holding business cards, there this compartment can be hidden behind the other compartments of the attachment.

It is a principal object of the invention to provide a device to aid a golfer in stretching his or her back and shoulder muscles.

It is another object of the invention to provide a device that can collapse down to a smaller size so that it is easier to carry while playing golf.

It is a final object of this invention to provide a device that can easily and efficiently store a multitude of personal items and items commonly used in the game of golf without interfering with the functional purpose of aiding the golfer in stretching his or her back and shoulder muscles.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
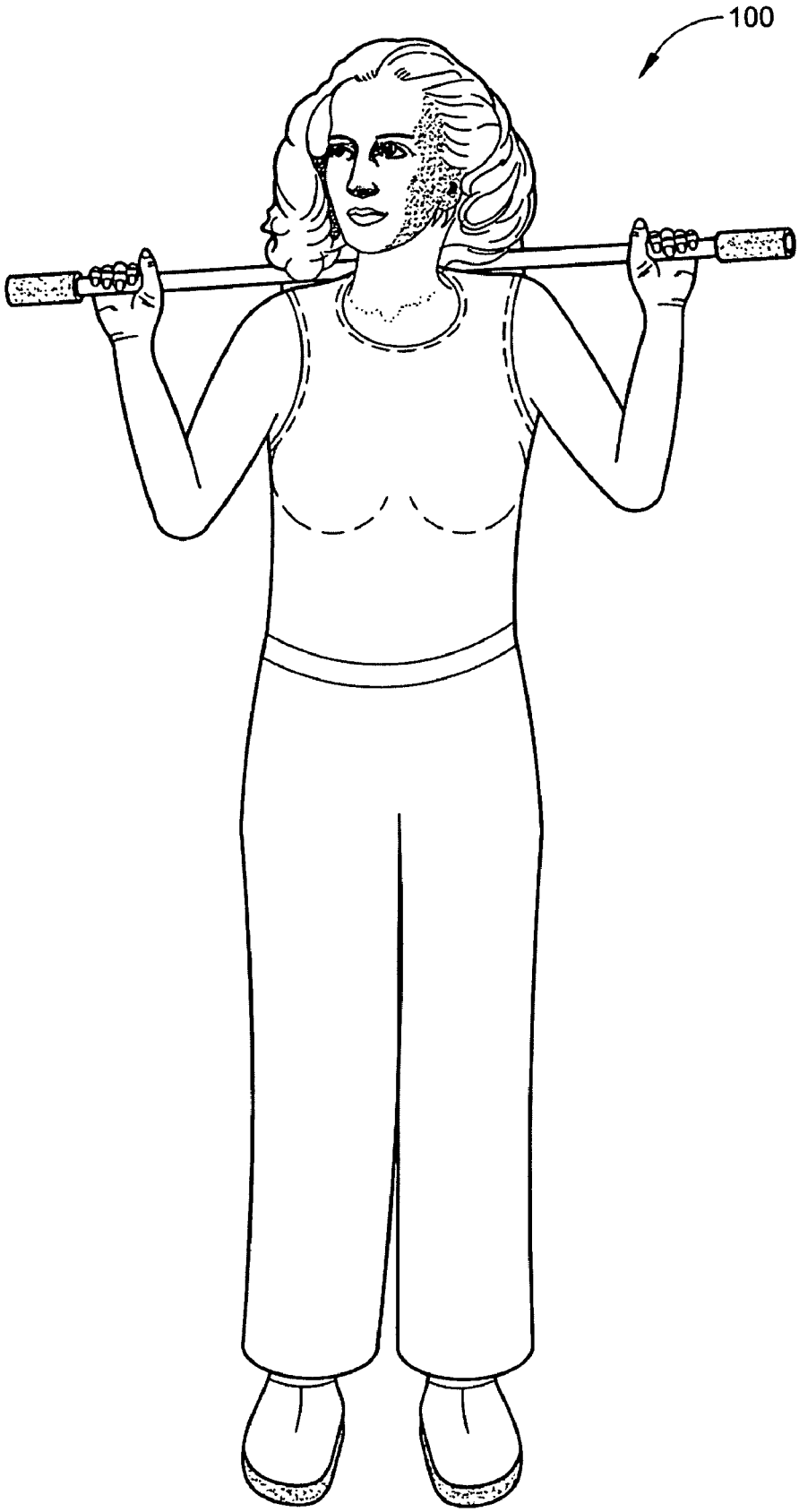
FIG. 1 is view of a user stretching with the golf exercise device.

Many aspects of the invention can be better understood with reference to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a view of a user stretching with the golf exercise device. A user is holding the golf exercise device 100 behind her head across her shoulders, grasping it with her hands.

Figure 2:
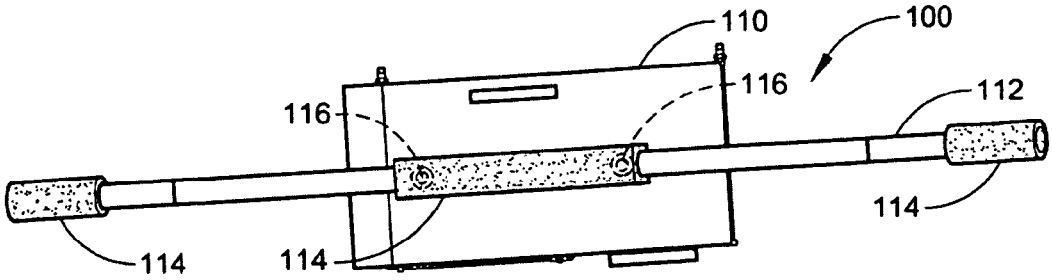
FIG. 2 is a front view of the golf exercise device.

FIG. 2 is a front view of the golf exercise device. The golf exercise device 100 is in the expanded position, ready for a golfer to use it for stretching. The golf exercise device 100 includes a shaft 112 that can be expanded or collapsed. At each end of the shaft 112 there is padding 114 that a golfer can use to more comfortably grasp the golf exercise device 100. There is padding 114 also located in the middle of the shaft 112 of the golf exercise device 100, where the golf exercise device 100 rests against the user's neck. An attachment 110 can be connected to the shaft 112 by means of snapping buttons 116, or alternatively, straps.

Figure 3:
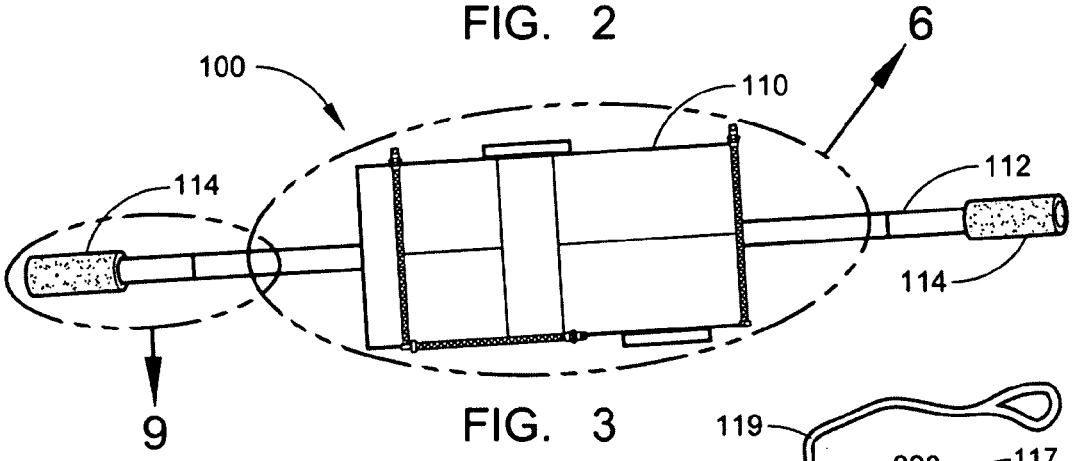
FIG. 3 is a back view of the golf exercise device.

FIG. 3 is a back view of the golf exercise device. The golf exercise device 100 is in the expanded position, ready for a golfer to use it for stretching. The golf exercise device 100 includes a shaft 112 that can be expanded or collapsed. At each end of the shaft 112 there is padding 114 that a golfer can use to more comfortably grasp the golf exercise device 100. An attachment 110 can be connected to the shaft 112. The attachment 110 inside of area 6 is more clearly shown in FIG. 6. The portion of the shaft 112 inside of area 9 is more clearly shown in FIG. 9.

Figure 4:
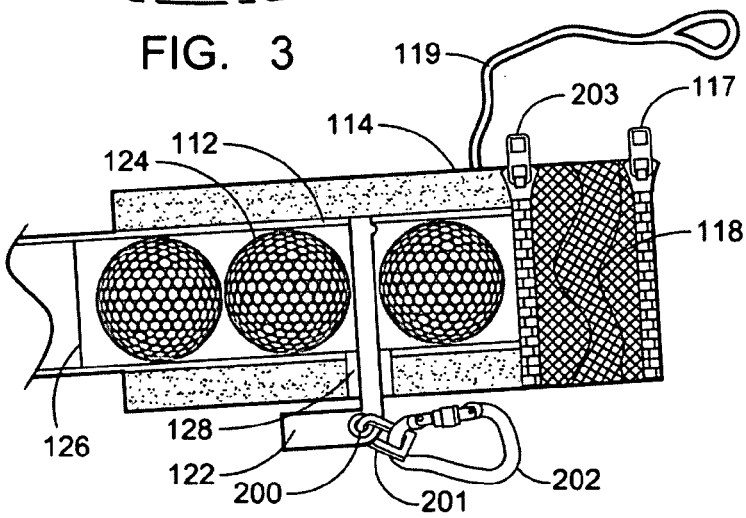
FIG. 4 is a cutaway view of the golf ball containing end of the golf exercise device.

FIG. 4 is a cutaway view of the golf ball containing end of the golf exercise device. The end of the shaft 112 is surrounded by padding 114. An inner wall 126 inside of the shaft 112 creates a compartment that can contain golf balls 124. An attachment pullout 122 slides through the shaft 112 through a cut-out portion 128. The attachment pullout 122 can be used to help secure the device to the external portion of a golf bag. This device is connected to a golf bag by a carabineer 202 that is attached to a connecting loop 201 where the connecting loop 201 goes through a hole 200 in the attachment pullout 122. The attachment pullout 122 also serves the function of restraining the golf balls 124 inside of the compartment. The golf balls 124 are removed from the shaft by withdrawing the attachment pullout 122 from the shaft 112. A water resistant bag 118 is connected to the end of the shaft 112. The water resistant bag 118 is made from a material where water does not easily pass through it. The water resistant bag 118 can be collapsed into itself, and secured to the shaft 112 by means of a zipper 117. The water resistant bag 118 can be used to cover and protect items such as golf shoes in addition to the device. This end of the shaft 112 can also have a bungee cord 119, where the bungee cord 119 can be used to attach the device to various items including a golf bag. A golf ball access zipper 203 can be used to access the golf balls 124 located inside of the shaft 112.

Figure 5:
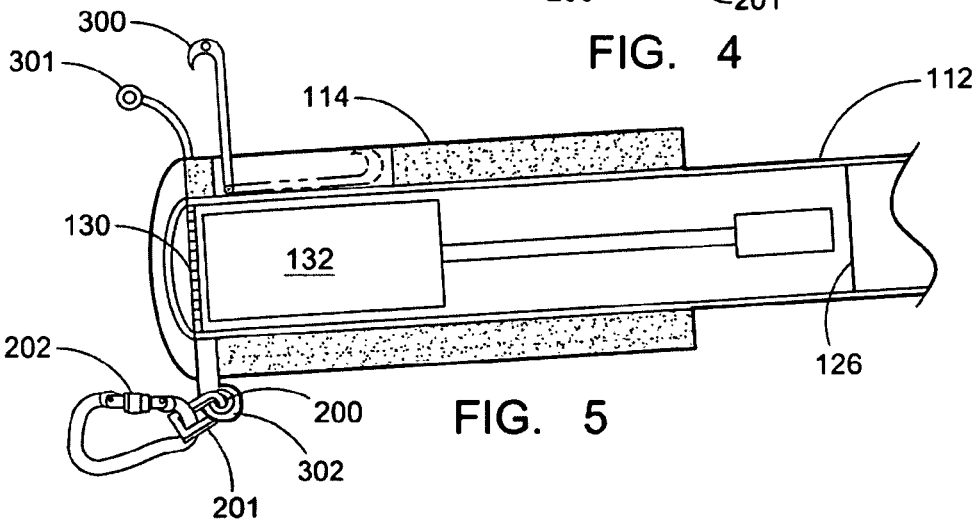
FIG. 5 is a cutaway view of the golf ball retrieving end of the golf exercise device.

FIG. 5 is a cutaway view of the golf ball retrieving end of the golf exercise device. The end of the shaft 112 is surrounded by padding 114. An inner wall 126 inside of the shaft 112 creates a compartment that can contain a net for retrieving golf balls 132. The net for retrieving golf balls 132 can be a telescoping and collapsible, such that the net for retrieving golf balls 132 telescope to retrieve golf balls from a water hazard and also collapse back inside of the shaft 112. An end cap 130 retains the net for retrieving golf balls 132 while it is not in use. An embedded hook 300 is included in this end of the shaft 112, and can be used to hook the device onto other items such as a golf bag. Also included on this end of the shaft 112 is an eyelet 301 for attaching various items to the stick, such as a laminated membership card, identification tag, carabineer, or any other object that can be connected to an eyelet. A larger eyelet 302 is included on this end of the shaft 112. The larger eyelet 302 includes a hole 200 with a connecting loop 201 that, in this embodiment of the invention, is connected to a carabineer 202. An optional LED (not shown) can be included in the net for retrieving golf balls 132, and can be used to illuminate small areas, such as when retrieving a golf ball. The optional LED can be powered by small batteries (not shown) located within the net for retrieving golf balls 132.

Figure 6:
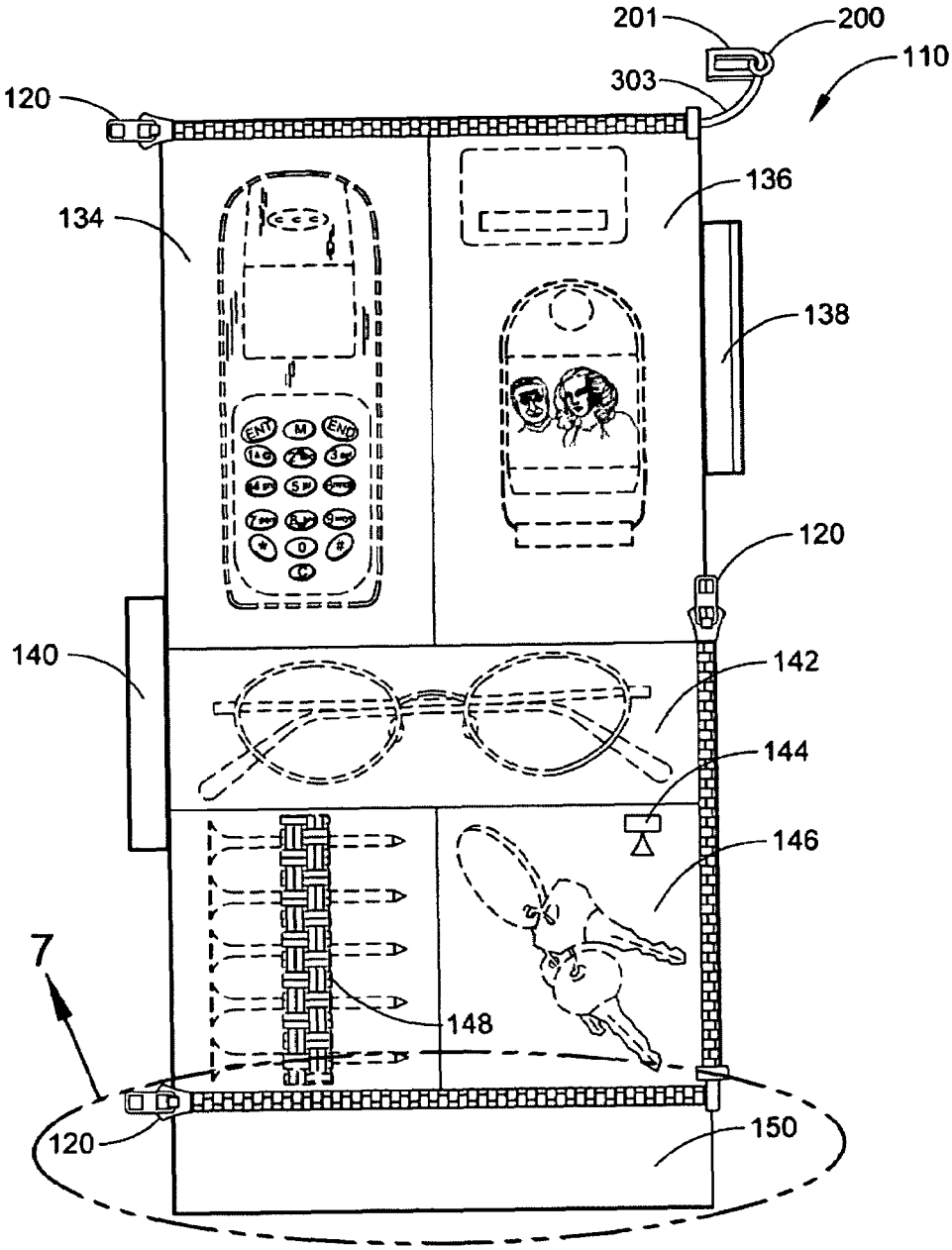
FIG. 6 is a top view of the attachment.

FIG. 6 is a top view of the attachment. The attachment 110 includes various compartments that can hold a multitude of items. There is a first long compartment 134 and second long compartment 136 to hold items such as wallets, sun block, mobile phones, PDAs, digital music players, or the like. First long compartment 134 and second long compartment 136 can be accessed by opening a zipper 120. There is also a sunglasses compartment 142 for storing items such as sunglasses and a keys compartment 146 for storing items such as keys. The sunglasses compartment 142 and keys compartment 146 are both accessed by opening a zipper 120. The attachment 110 also includes an apparatus for securing golf tees 148. A first pullout bag 138 and a second pullout bag 140 can be pulled out of the attachment 110. The first pullout bag 138 and second pullout bag 140 are preferably made of a net-type material, which allows the user to see the contents of either bag without opening the bag. When pulled out, the first pullout bag 138 and second pullout bag 140 can be closed by using a drawstring closure. When not in use, the first pullout bag 138 and second pullout bag 140 can be folded and secured into the attachment 110. Various means can be used to secure the first pullout bag 138 and second pullout bag 140 into the attachment, include snaps, zippers, and hook and loop fasteners. These pullout bags can be used to carry items such as wallets, sun block, mobile phones, PDAs, digital music players, or the like. Finally, the attachment 110 can also contain a drop down bag (not shown), which can be folded in on itself and secured inside of a pocket 150 of the attachment 110 by means of a zipper 120. The drop down bag inside of area 7 is deployed in FIG. 7. An eyelet 303 is included with the attachment 110. The eyelet 303 includes a hole 200 with a connecting loop 201 that can have various items connected to it, including a key ring, luggage tag, carabineer, or the like. The connecting loop 201 can also be used as an additional means of attaching the device to a golf bag.

Figure 7:
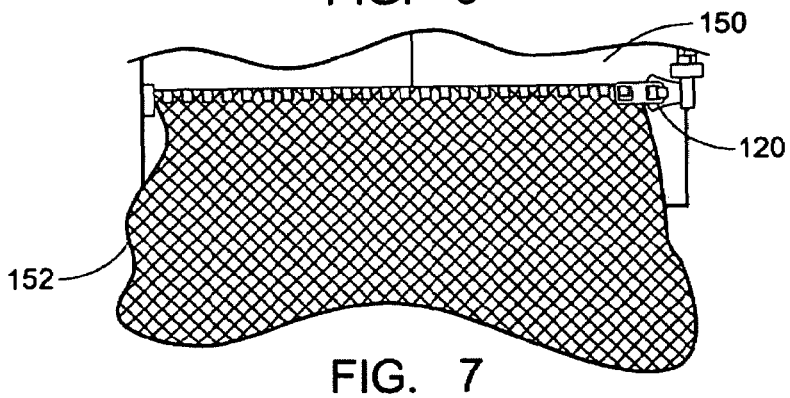
FIG. 7 is a partial top view of the attachment with the collapsible mesh bag exposed.

FIG. 7 is a partial top view of the attachment with the collapsible mesh bag exposed. When the zipper 120 is open, a drop down bag 152 can be deployed. The drop down bag 152 can be used to store various items, such as snacks, but can also be folded in on itself and secured inside of a pocket 150 of the attachment. It can be accessed by means of a zipper, drawstring, or both.

Figure 8:
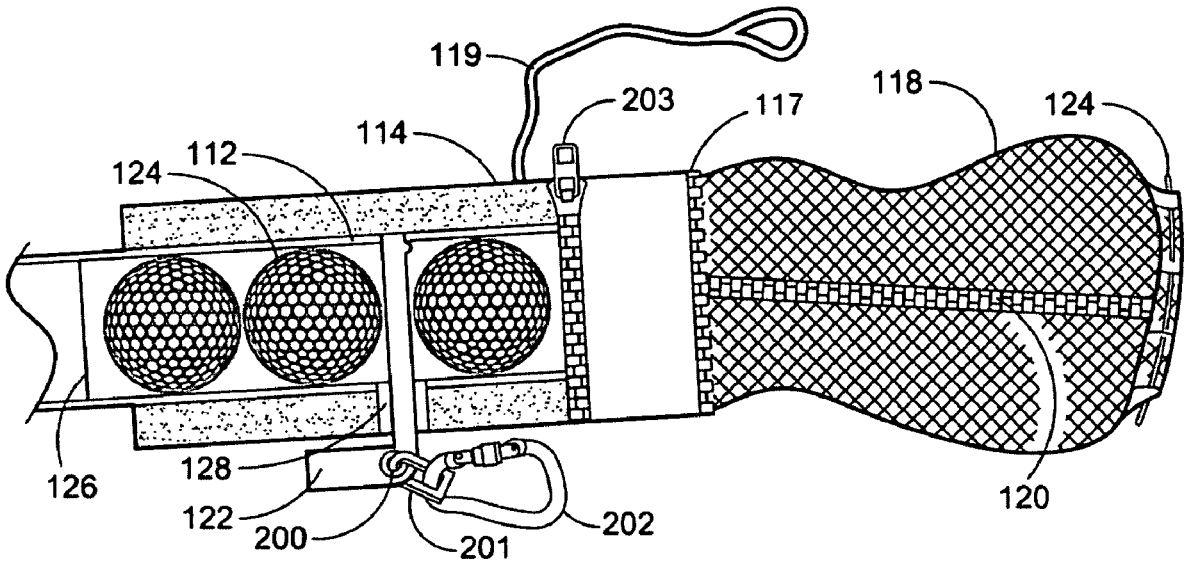
FIG. 8 is a cutaway view of the golf ball containing end of the golf exercise device with the water resistant bag deployed.

FIG. 8 is a cutaway view of the golf ball containing end of the golf exercise device with the water resistant bag deployed. The end of the shaft 112 is surrounded by padding 114. An inner wall 126 inside of the shaft 112 creates a compartment that can contain golf balls 124. An attachment pullout 122 slides through the shaft 112 through a cut-out portion 128. The attachment pullout 122 can be used to help secure the device to the external portion of a golf bag. This device is connected to a golf bag by a carabineer 202 that is attached to a connecting loop 201 where the connecting loop 201 goes through a hole 200 in the attachment pullout 122. The attachment pullout 122 also serves the function of restraining the golf balls 124 inside of the compartment. The golf balls 124 are removed from the shaft by withdrawing the attachment pullout 122 from the shaft 112 such that a single ball is allowed to exit the compartment. A golf ball access zipper 203 can be used to access the golf balls 124 located inside of the shaft 112. A water resistant bag 118 is connected to the end of the shaft 112. The water resistant bag 118 is made from a material where water does not easily pass through it. The water resistant bag 118 can be collapsed into itself, and secured to the shaft 112 by means of a zipper 117. The water resistant bag 118 can be used out to cover and protect items such as golf shoes in addition to the device, and includes a zipper 120 and a drawstring closure 124. The zipper 120, drawstring closure 124, or both can be used to open and close the water resistant bag 118. This end of the shaft 112 can also have a bungee cord 119, where the bungee cord 119 can be used to attach the device to various items including a golf bag.

Figure 9:
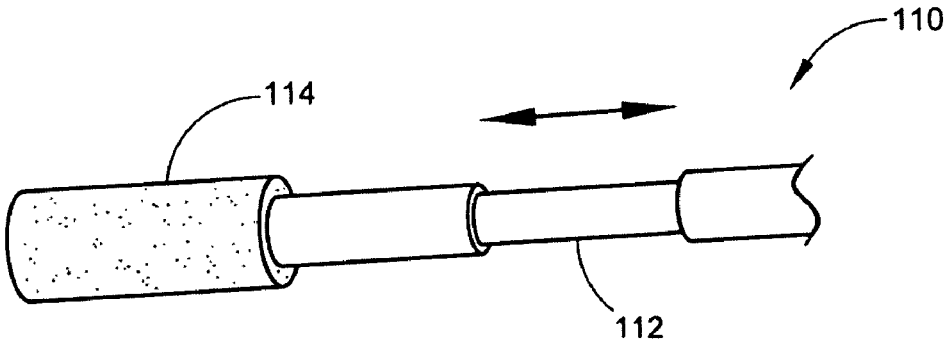
FIG. 9 is a partial side view of the device.

FIG. 9 is a partial side view of the device. The golf exercise device 110 includes a shaft 112 with padding 114. The shaft 112 of the golf exercise device 110 can telescope such that the length of the golf exercise device 110 can change.

What we claim is:

1. A device to aid a user in stretching his or her back and shoulder muscles comprising a telescoping shaft, where the shaft can expand to a length such that a golfer can place the device behind his or her head and grasp each end with outstretched arms, where the shaft can collapse to a size smaller than its expanded size, and where the shaft is hollow and has an external surface and an internal surface, padding, where the padding covers at least a portion of the external surface of the middle portion of the shaft and the entire circumference of the external surface near each end of the shaft, but not the entire shaft, and a first compartment, where the first compartment is located inside of the shaft at one end of the shaft, where the first compartment is bounded by at least the internal surface of the shaft and one inner wall, and where at least one golf ball can fit inside of the first compartment, and an attachment pullout, where the attachment pullout can be slid from a closed position to a withdrawn position, where the attachment pullout, when in the closed position, bounds the first compartment such that items located within the compartment cannot be removed, where the attachment pullout, when in the withdrawn position, does not cause the first compartment to be completely enclosed such that items located within the compartment can be removed, wherein the attachment pullout is coupled to the telescoping shaft through a cut-out portion of the telescoping shaft.

2. The device of claim 1, further comprising a second compartment, where the second compartment is inside of the shaft at the end of the shaft opposite of the first compartment, where the second compartment is bounded by at least the internal surface of the shaft and one inner wall.

3. The device of claim 2, further comprising a net for retrieving golf balls, where the net for retrieving golf balls is collapsible, where, when the net for retrieving golf balls is collapsed, it will fit inside of and can be stored in the second compartment, and where the net for retrieving golf balls is capable of retrieving golf balls from shallow portions of water hazards.

4. The device of claim 1, where at least three golf balls can fit inside of the first compartment.

5. The device of claim 1, further comprising a water resistant bag, where the water resistant bag comprises walls and a zipper, a drawstring closure, or both, where the water resistant bag is attached to the device at the end of the shaft where the first compartment is located, where the water resistant bag can collapse and be stored inside of or proximate to the shaft, where the water resistant bag can be used to cover at least a portion of the device, and where the walls of the bag do not allow significant amounts of water to pass through its surface.

6. The device of claim 1, further comprising an attachment, where the attachment comprises one or more compartments for storing personal belongings, where the attachment is secured to the shaft of the device.

7. The device of claim 6, where the attachment is secured to the shaft of the device by one or more snaps.

8. The device of claim 6, where the attachment further comprises a drop down bag, where the drop down bag comprises walls and a zipper, a drawstring closure, or both, where the drop down bag can be folded up and secured inside of the attachment.

9. The device of claim 8, where the drop down bag can be stored inside of a zippered pocket when not in use.

10. The device of claim 6, where the attachment further comprises a means for fastening tees to the attachment.

11. The device of claim 6, where the attachment comprises four or more pockets.

12. The device of claim 6, where the attachment further comprises a pull out bag, where the pull out bag comprises walls, where the pull out bag can be pulled out of and put back into the attachment.

13. A device to aid a user in stretching his or her back and shoulder muscles comprising a telescoping shaft, where the shaft can expand to a length such that a golfer can place the device behind his or her head and grasp each end with outstretched arms, where the shaft can collapse to a size smaller than its expanded size, and where the shaft is hollow and has an external surface and an internal surface, padding, where the padding covers the a portion circumference of the external surface of the middle portion of the shaft and the entire circumference of the external surface near each end of the shaft, but not the entire shaft, a first compartment, where the first compartment is located inside of the shaft at one end of the shaft, where the first compartment is bounded by at least the internal surface of the shaft and one inner wall, and where at least one golf ball can fit inside of the first compartment, a second compartment, where the second compartment is inside of the shaft at the end of the shaft opposite of the first compartment, where the second compartment is bounded by at least the internal surface of the shaft and one inner wall, and a net for retrieving golf balls, where the net for retrieving golf balls is collapsible, where, when the net for retrieving golf balls is collapsed it, will fit inside of and can be stored in the second compartment, and where the net for retrieving golf balls is capable of retrieving golf balls from shallow portions of water hazards, a water resistant bag, where the water resistant bag comprises walls and a zipper, a drawstring closure, or both, where the water resistant bag is directly attached to the device at the end of the shaft where the first compartment is located, where the water resistant bag can collapse and be stored inside of proximate to the shaft, where the water resistant bag can be used to cover at least a portion of the device, and where the walls of the bag do not allow significant amounts of water to pass through its surface, an attachment pullout, where the attachment pullout can be slid from a closed position to a withdrawn position, where the attachment pullout, when in the closed position, bounds the first compartment such that items located within the compartment cannot be removed, where the attachment pullout, when in the withdrawn position, does not cause the first compartment to be completely enclosed such that items located within the compartment can be removed, an attachment, where the attachment comprises four or more compartments for storing personal belongings, where the four our more pockets are accessed by zippers, and where the attachment is secured to the shaft of the device, where the attachment further comprises a drop down bag, where the drop down bag comprises walls and a zipper, drawstring closure, or both, where the drop down bag can be folded up and secured inside of the attachment and where the drop down bag can be stored inside of a zippered pocket when not in use, where the attachment further comprises a pull out bag, where the pull out bag comprises walls and a drawstring closure, where the pull out bag can pulled out of and put back into the attachment.

* * * * *